US005749772A

United States Patent [19]

Shimokawa

[11] Patent Number: 5,749,772

[45] Date of Patent: May 12, 1998

[54] METHOD AND APPARATUS FOR POLISHING WAFER

[75] Inventor: Kimiaki Shimokawa, Tokyo, Japan

[73] Assignee: Oki Electric Industry Co., Ltd., Tokyo, Japan

[21] Appl. No.: 756,902

[22] Filed: Dec. 2, 1996

[30] Foreign Application Priority Data

Feb. 28, 1996 [JP] Japan ..... 8-040795

[51] Int. Cl.[6] ..... B24B 53/00

[52] U.S. Cl. ..... 451/53; 451/41; 451/56; 451/287

[58] Field of Search ..... 451/41, 53, 56, 451/285, 287, 288, 7

[56] References Cited

U.S. PATENT DOCUMENTS

| | | | |
|---|---|---|---|
| 5,081,051 | 1/1992 | Mattingly et al. | 451/56 |
| 5,291,693 | 3/1994 | Nguyen | 451/56 |
| 5,456,627 | 10/1995 | Jackson et al. | 451/56 |
| 5,643,067 | 7/1997 | Katsuoka et al. | 451/56 |
| 5,645,682 | 7/1997 | Skrovan | 451/56 |

*Primary Examiner*—Eileen P. Morgan
*Attorney, Agent, or Firm*—Rabin, Champagne & Lynt, P.C.

[57] ABSTRACT

A polishing pad is conditioned using a conditioning disc whose temperature is controlled upon Chemical Mechanical Polish. The temperature of the polishing pad remains unchanged upon conditioning and uniform CMP can be carried out.

15 Claims, 7 Drawing Sheets

METHOD AND APPARATUS FOR POLISHING WAFER

BACKGROUND OF THE INVENTION

1. Field of the Invention

This invention relates to a method of polishing a wafer, and particularly to a method of and an apparatus for effecting Chemical Mechanical Polish (CMP).

2. Description of the Related Art

FIG. 6 is a view showing the manner of execution of conventional CMP as seen from above. FIG. 7 is a view as seen from the side. FIG. 8 is a view illustrating the state in which a conditioning disc 6 employed in CMP is on standby. FIG. 9 is a view showing the manner of arrangement or conditioning of the surface of a polishing pad 4 as seen from above.

As shown in FIG. 7, wafer rotating discs 2 adsorb a wafer 1 and press the wafer 1 against the polishing pad 4 while being rotated. The polishing pad 4 is placed on a polish wheel 3 and rotated together with the polish wheel 3. At this time, polishing materials 5 (such as colloidal silica) drop onto the surface of the polishing pad 4. Thereafter, the CMP is executed for a predetermined time interval.

After completion of the CMP, the wafer rotating discs 2 detaches the wafer 1 from the polishing pad 4.

Thereafter, pad conditioning is performed in the following manner to arrange the surface of the polishing pad 4.

The conditioning disc 6 held by an arm 7 is pressed against the surface of the polishing pad 4 by a predetermined force. At this time, the polishing pad 4 is rotating together with the polish wheel 3. Further, the conditioning disc 6 is also rotating.

To arrange the surface of the polishing pad 4, the arm 7 displaces the conditioning disc 6 from a point A to a point B both shown in FIG. 9.

Such pad conditioning is performed to stabilize the CMP. If the pad conditioning is not done, a reduction in removal rate and deterioration in uniformity of the removal rate within each wafer occur according to an increase in the number of wafers that have been processed by a CMP apparatus.

This is because the surface of the polishing pad 4 is clogged with the polishing materials 5. Accordingly, the pad conditioning is done to shave or cut off the polishing materials with which the surface of the polishing pad 4 is clogged. As the conditioning disc 6, a brush, a disc set with diamonds, or the like is used.

In the present pad conditioning method, however, the temperature of the conditioning disc 6 varies the temperature of the surface of the polishing pad 4 upon pad conditioning. Therefore, the pad conditioning method is accompanied by a problem that polishing is made unstable in an early stage of the CMP subsequent to the pad conditioning.

FIG. 10 is a view illustrating the relationship in CMP between the time from the commencement of polishing and the temperature of the surface of the polishing pad 4. In the drawing, the vertical axis indicates the temperature (°C.) of the surface of the polishing pad 4 and the horizontal axis indicates a polishing time interval (second).

As shown in FIG. 10, 60 to 70 seconds are required between the commencement of the polishing and the stabilization of the temperature of the surface of the polishing pad 4. This stable temperature is considered to result from the fact that the temperature of the surface of the polishing pad 4 increases due to friction produced between the polishing pad 4 and the wafer 1, so that the temperature thereof is brought into saturation at a certain temperature.

However, even if the surface temperature is placed in a stable state at the predetermined temperature, the temperature of the surface of the polishing pad 4 is suddenly reduced upon commencement of the pad conditioning.

This is because the conditioning disc 6 is brought into contact with the polishing pad 4 at the temperature of the conditioning disc 6, which is different from the stable temperature of the polishing pad 4 upon CMP. As shown in FIG. 8, the conditioning disc 6 is immersed into a water tank 8 on standby. The temperature of the conditioning disc 6 is set to a temperature substantially identical to the temperature of water stored in the water tank 8.

Namely, since the temperature of the water in the water tank 8 and the stable temperature of the polishing pad 4 are different from each other, the conditioning disc 6 will lower the temperature of the surface of the polishing pad 4.

During a polishing cycle after the pad conditioning, the temperature of the surface of the polishing pad 4 starts to change from a low temperature and 60 to 70 seconds are required to stabilize the temperature thereof. During 60 to 70 seconds, the temperature of the surface of the polishing pad 4 changes from moment to moment. This change in temperature becomes a big unstable factor that will interfere with accurate processing employed in the CMP.

Such a problem arises from the fact that the pad conditioning is performed without controlling the temperature of the conditioning disc 6. The pad conditioning is carried out in various ways as in cases where the pad conditioning is performed once per CMP and once per three CMP, for example. However, the stable temperature of the polishing pad 4 varies each time the pad conditioning is carried out.

SUMMARY OF THE INVENTION

With the foregoing in view, it is therefore an object of the present invention to provide uniform CMP by carrying out CMP at a normally stable temperature. It can be thus expected that a characteristic of a semiconductor device is stabilized and the yield of mass-production of the semiconductor device is improved.

In order to achieve the above object, there is provided a typical method of polishing a wafer, comprising the following steps:

- a step for pressing the wafer against a polishing portion on a polish wheel and applying relative motion between the wafer and the polish wheel so as to polish the surface of the wafer;
- a step for controlling a conditioning tool to a predetermined temperature; and
- a step for effecting conditioning on the polishing portion using the conditioning tool.

The present application discloses other various inventions made to achieve the object. Theses inventions will be understood from the appended claims, the following embodiments and the accompanying drawings.

BRIEF DESCRIPTION OF THE DRAWINGS

While the specification concludes with claims particularly pointing out and distinctly claiming the subject matter which is regarded as the invention, it is believed that the invention, the objects, features and advantages thereof will be better understood from the following description taken in connection with the accompanying drawings in which:

DETAILED DESCRIPTION OF THE PREFERRED EMBODIMENTS

Figure 1:
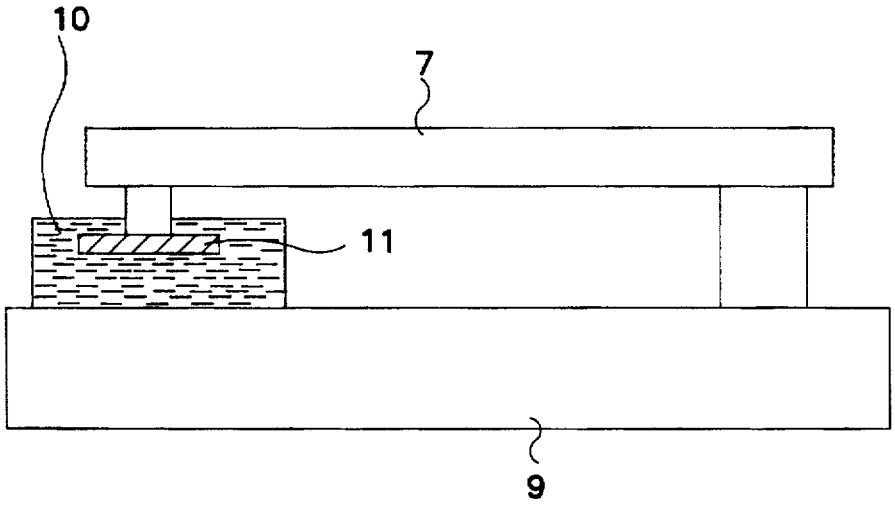
FIG. 1 is a view showing the state in which a conditioning disc employed in CMP according to a first embodiment of the present invention is on standby.

FIG. 1 is a view showing the state in which a conditioning disc 11 employed in CMP according to a first embodiment of the present invention is on standby. The first embodiment will be described below with reference to FIG. 1.

The initial wafer is first subjected to the CMP. In doing so, the temperature of the surface of a polishing pad 4 reaches a stable temperature at 60 to 70 seconds after the commencement of the CMP in a manner similar to the state shown in FIG. 10.

After completion of the subjection of the initial wafer to the CMP, pad conditioning is effected on the surface of the polishing pad 4. The conditioning disc 11 is waiting in a liquid tank 10 placed under a predetermined temperature upon standby. The temperature of a liquid held in the liquid tank 10 is set to a temperature substantially identical to the stable temperature of the surface of the polishing pad 4.

Figure 10:
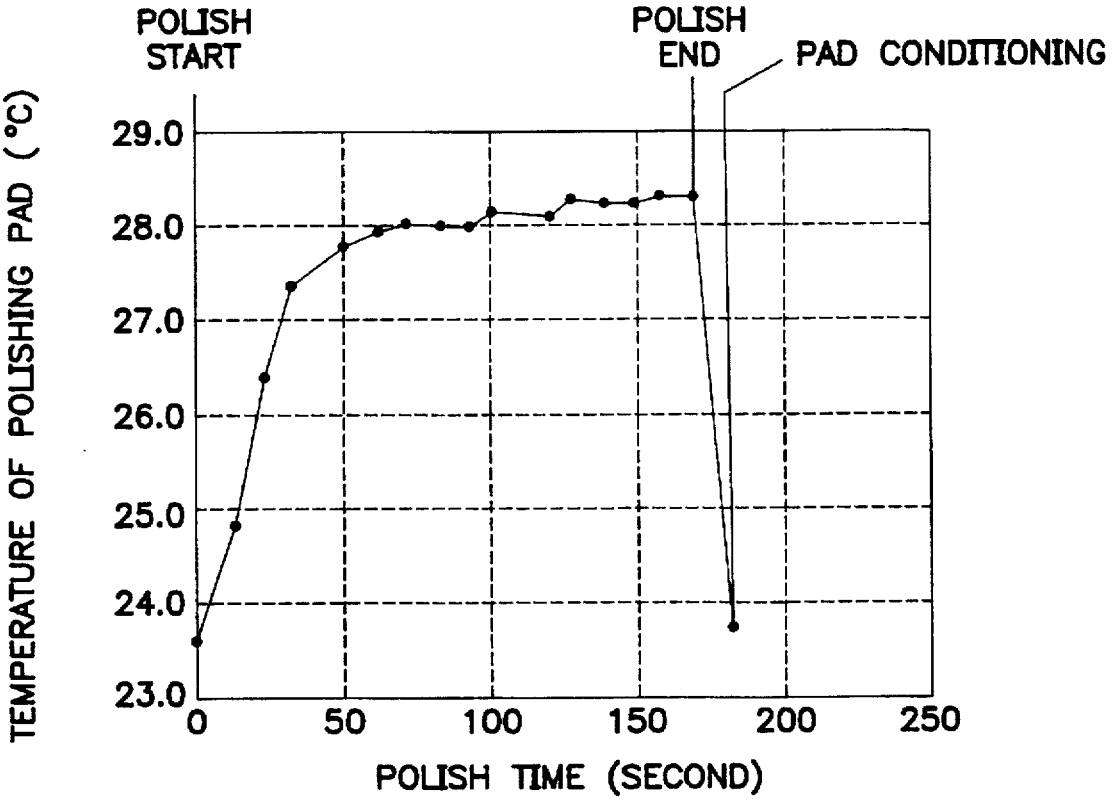
FIG. 10 is a view illustrating the relationship between the time from the commencement of polishing and the temperature of the surface of a polishing pad.

Therefore, the conditioning disc 11 is brought into contact with the polishing pad 4 at substantially the same temperature as the stable temperature of the surface of the polishing pad 4 upon pad conditioning. As a result, a reduction in temperature at the time of the pad conditioning, which is shown in FIG. 10, does not occur.

All the wafers excluding the initial wafer are polished at the stable temperature by conducting the pad conditioning in accordance with such a method.

As a result, the CMP can be made uniform, and the stability of a characteristic of a semiconductor device and the yield of mass-production thereof can be enhanced.

Since non-stable time intervals ranging from 60 to 70 seconds do not exist, precise CMP can be established. Namely, a short CMP time interval of 30 or 20 seconds can be also set.

Thus, the thickness of an object to be polished can be set thinner in a process for polishing the semiconductor device. This will result in a reduction in manufacturing cost.

With the decrease in thickness, variations in thickness are also reduced. Accordingly, the process is stabilized and hence becomes more suitable for mass-production.

The present embodiment has described, as one example, the case where the pad conditioning is performed once on a per-CMP basis. However, the pad conditioning may be performed once or the like on a per-three CMP basis as needed.

Figure 2:
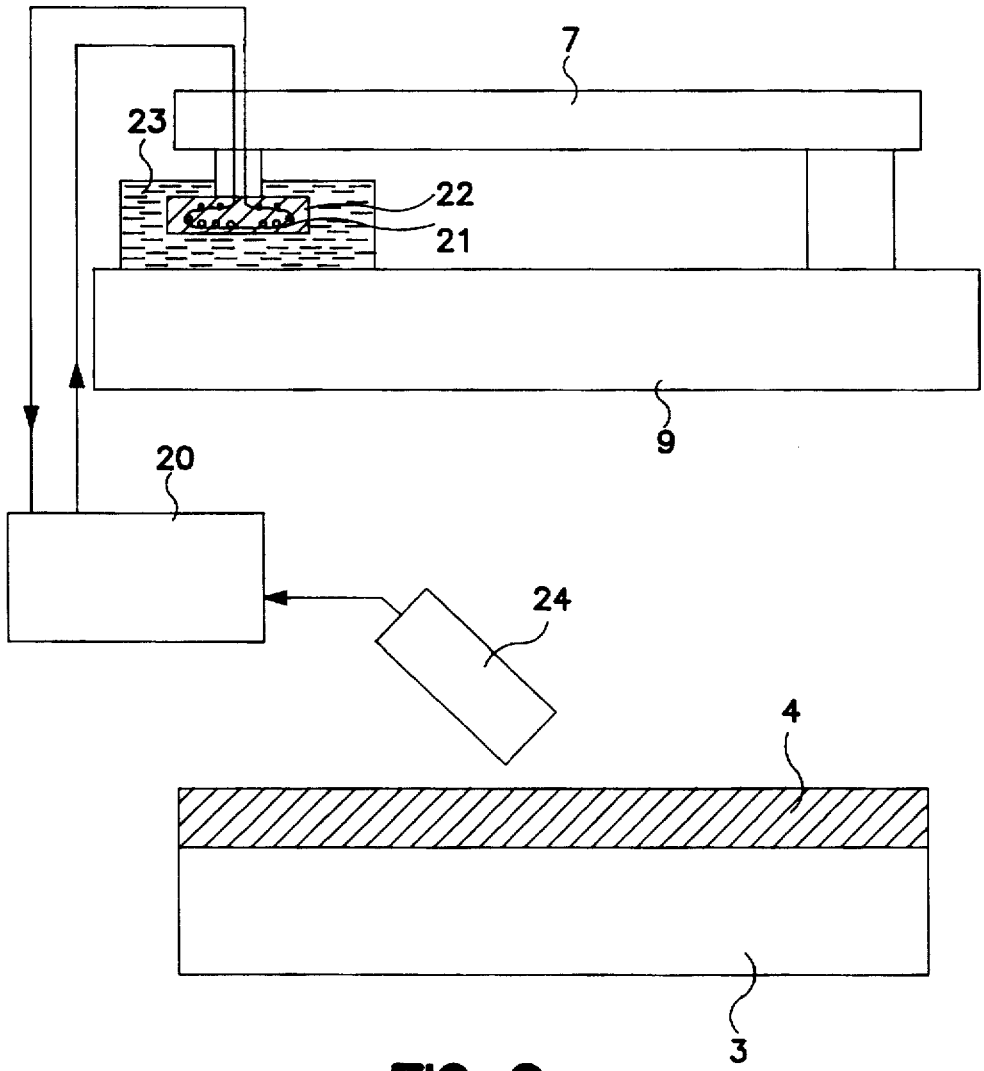
FIG. 2 is a view illustrating the state in which a conditioning disc employed in CMP according to a second embodiment of the present invention is on standby.

FIG. 2 is a view showing the state in which a conditioning disc employed in CMP according to a second embodiment of the present invention is on standby. The second embodiment will be described below using FIG. 2.

A process for performing pad conditioning after a CMP process is similar to that employed in the first embodiment.

In the second embodiment, a heater 21 for resistance heating is provided inside a conditioning disc 22. A current regulating power source 20 is also provided. The current regulating power source 20 regulates the current which flows into the heater 21.

The temperature of the conditioning disc 22 is controlled by regulating the current that flows into the heater 21. This temperature control is performed according to the temperature detected by an infrared temperature sensor 24.

Further, the temperature of the conditioning disc 22 may be also controlled according to the temperature which has been artificially set in advance.

Owing to such control on the temperature of the conditioning disc 22, the temperature of the conditioning disc 22 is always maintained at a temperature substantially identical to the temperature of the surface of a polishing pad 4. Even on pad conditioning, the conditioning disc 22 is brought into contact with the surface of the polishing pad 4 at substantially the same temperature.

In the second embodiment, the temperature of the conditioning disc 22 itself is controlled in addition to the effect obtained by the first embodiment. Therefore, the temperature of the surface of the polishing pad 4 remains substantially unchanged upon pad conditioning so that stabler polishing can be done.

Further, since a mechanism for controlling the temperature of the conditioning disc 22 is provided in a CMP apparatus, it is possible to control and manage the temperature of the conditioning disc.

Figure 3:
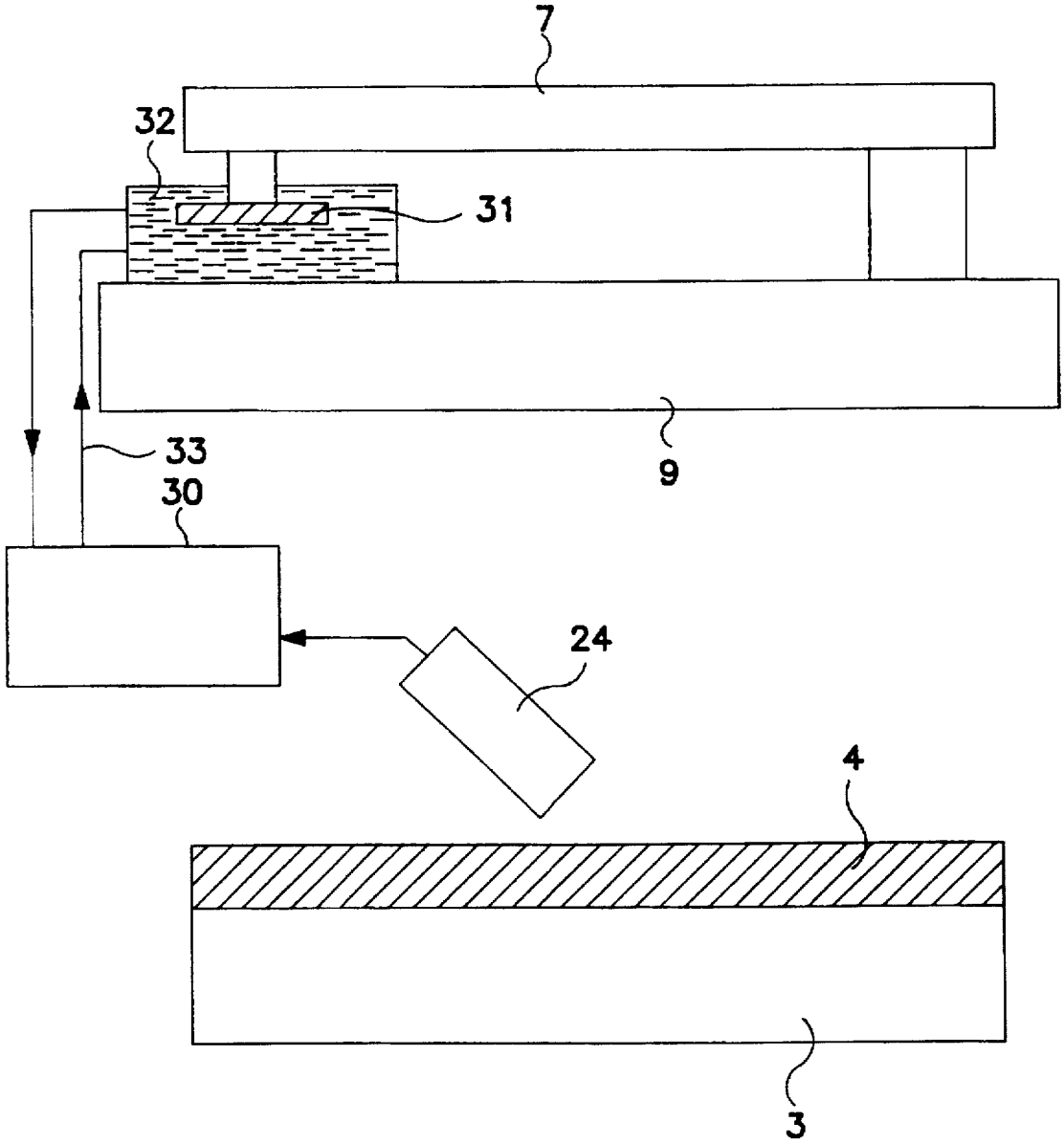
FIG. 3 is a view depicting the state in which a conditioning disc employed in CMP according to a third embodiment of the present invention is on standby.

FIG. 3 is a view illustrating the state in which a conditioning disc employed in CMP according to a third embodiment of the present invention is on standby. The third embodiment will be described below using FIG. 3.

Even in the case of the present embodiment, a pad conditioning process, which is executed after completion of a CMP process, is similar to that employed in the first embodiment.

In the third embodiment, a water tank 32, an isothermal circulating water unit 30, and piping 33 for coupling the water tank 32 and the isothermal circulating water unit 30 to each other are provided.

The temperature of the conditioning disc 31 is controlled by controlling the temperature of water in the water tank 32 in which a conditioning disc 31 is waiting. The temperature of the water in the water tank 32 is controlled by the isothermal circulating water unit 30. This temperature control is carried out based on the temperature detected by an infrared temperature sensor 24.

Since the control on the temperature of the conditioning disc 31 is done using the water tank 32 in the third embodiment, the conditioning disc 31 itself no needs to have a complex construction. The material and structure of the conditioning disc 31 can be set to the optimum conditions for effecting conditioning on a polishing pad 4.

Figure 4:
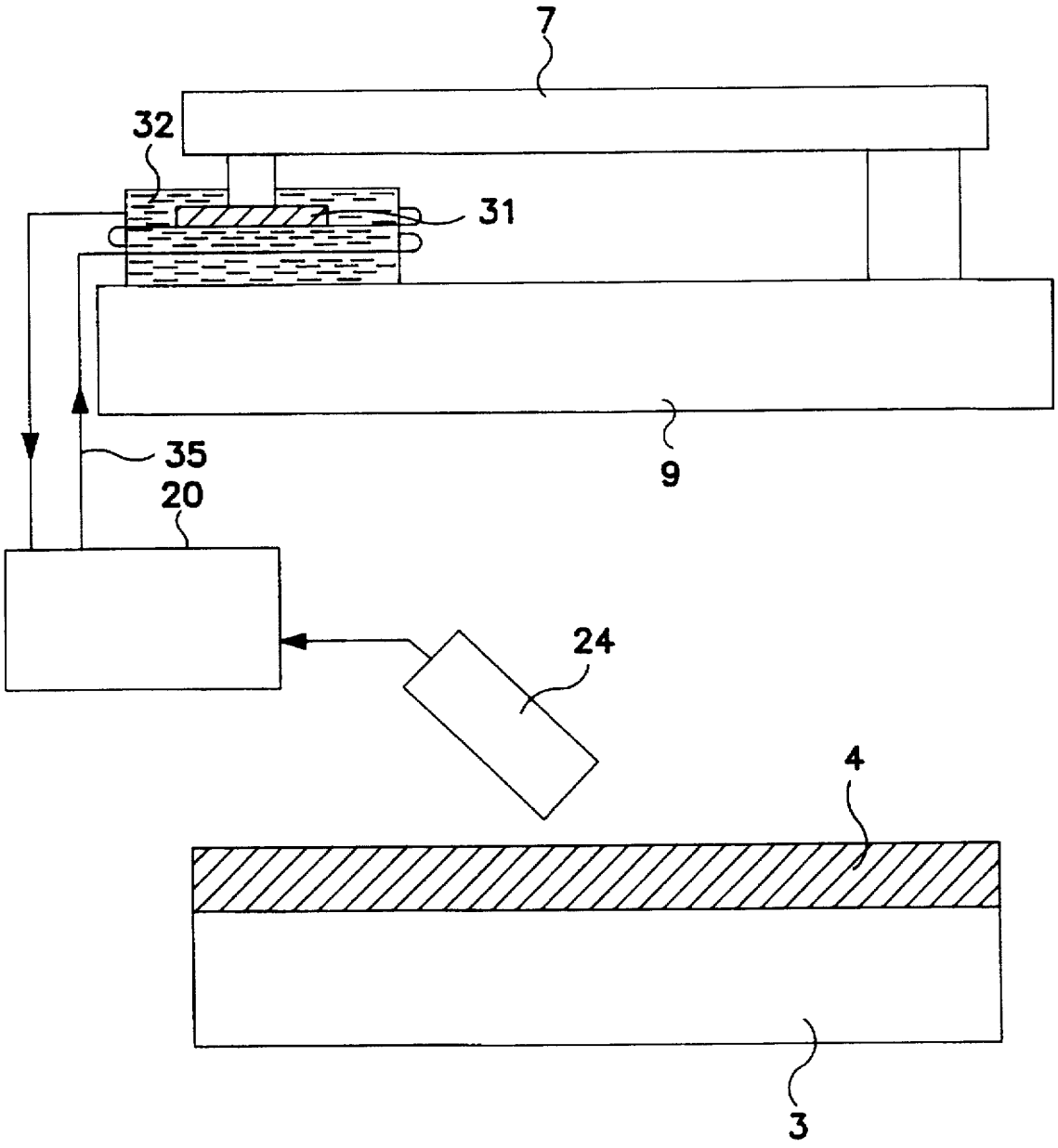
FIG. 4 is a view showing the state in which a conditioning disc employed in CMP according to a fourth embodiment of the present invention is on standby.

FIG. 4 is a view showing the state in which a conditioning disc employed in CMP according to a fourth embodiment of the present invention is on standby. The fourth embodiment will be described below using FIG. 4.

Even in the case of the present embodiment, a pad conditioning process, which is done after a CMP process, is similar to those employed in other embodiments.

A water tank 32 and a current regulator 20 are provided in the fourth embodiment. Further, a heater 35 for resistance heating is provided outside the water tank 32.

In the fourth embodiment, water stored in the water tank 32 is not directly circulated to control the temperature of the water. The temperature of the water in the water tank 32 is controlled by the heater 35 disposed outside the water tank 32. This temperature control is done according to the temperature detected by an infrared temperature sensor 24.

The water in the water tank 32 contains abrasives, etc. attached to the conditioning disc 31. Therefore, if a structure for preventing the water in the water tank from being directly circulated is adopted, efforts for maintaining circulating paths and an isothermal circulating water unit can be reduced and the structure can be also simplified.

Incidentally, the means for controlling the temperature of the water in the water tank 32 is not necessarily limited to the heating of the heater and may use another method.

Figure 5:
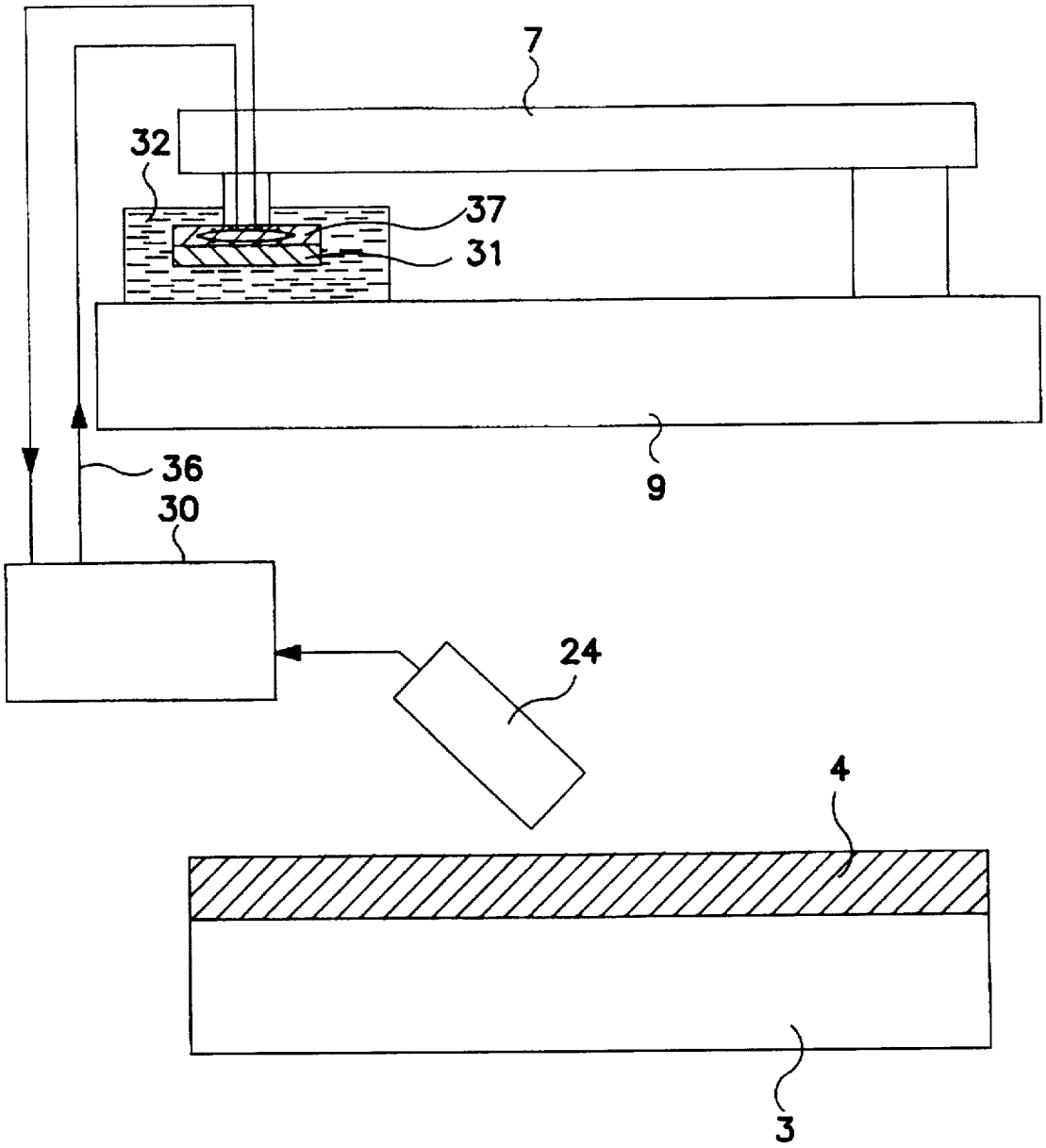
FIG. 5 is a view illustrating the state in which a conditioning disc employed in CMP according to a fifth embodiment of the present invention is on standby.
Figure 6:
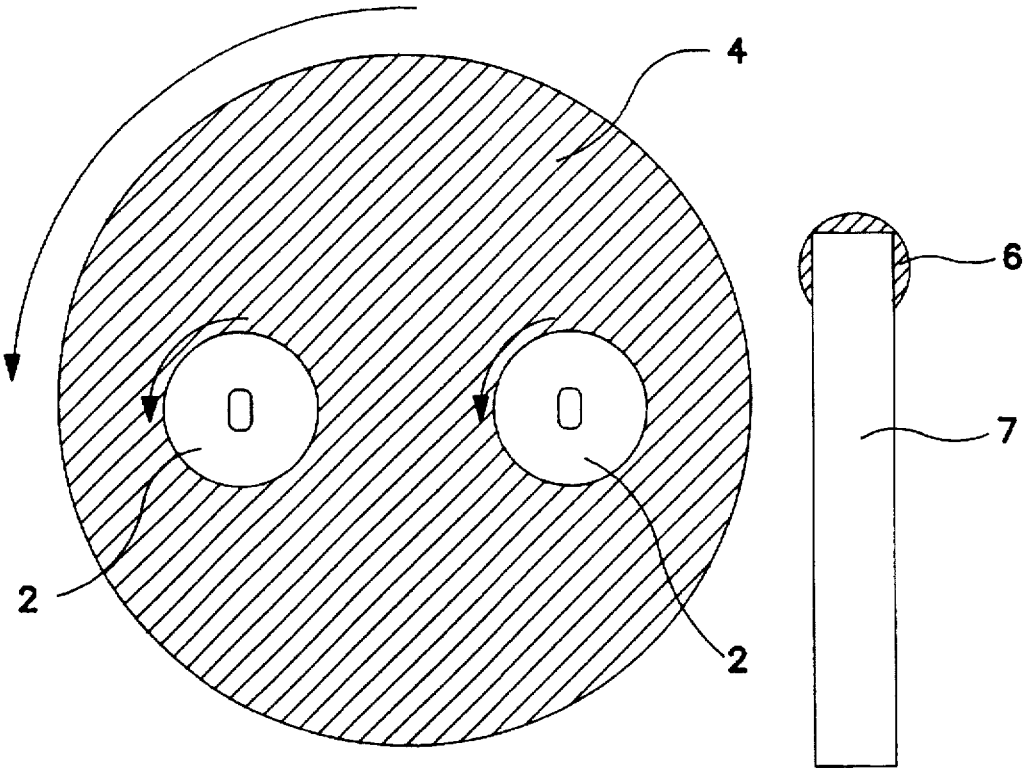
FIG. 6 is a top plan view showing the manner in which the conventional CMP is carried out.
Figure 7:
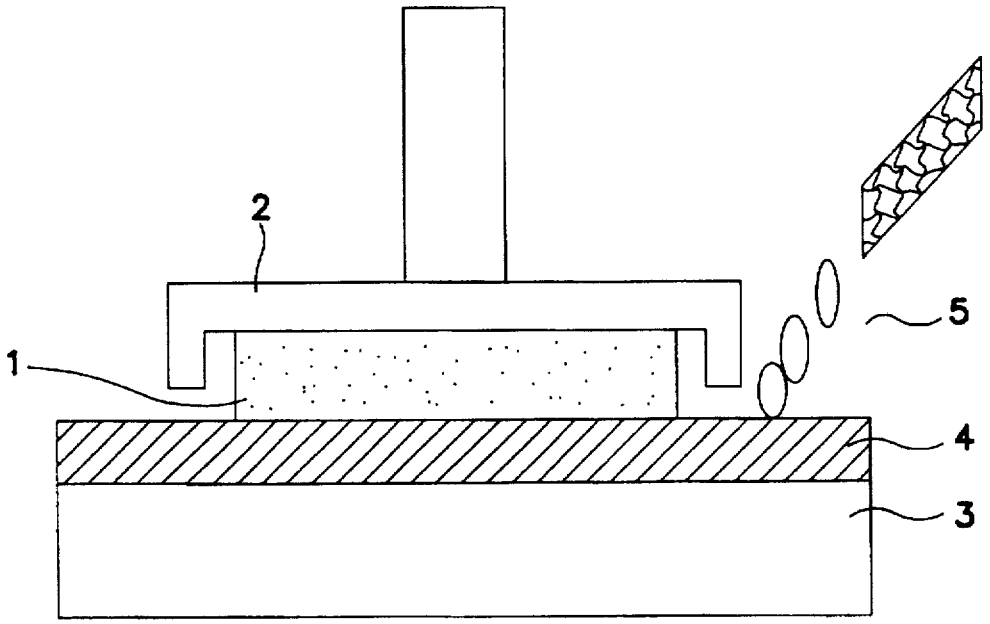
FIG. 7 is a cross-sectional view illustrating the manner in which the conventional CMP is done.
Figure 8:
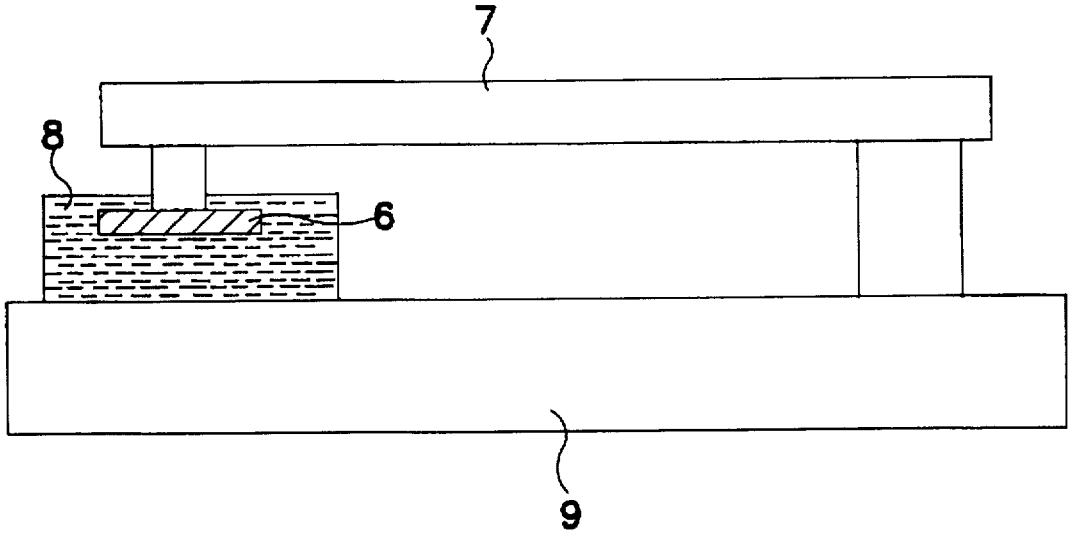
FIG. 8 is a view depicting the state in which a conditioning disc employed in the conventional CMP is on standby.
Figure 9:
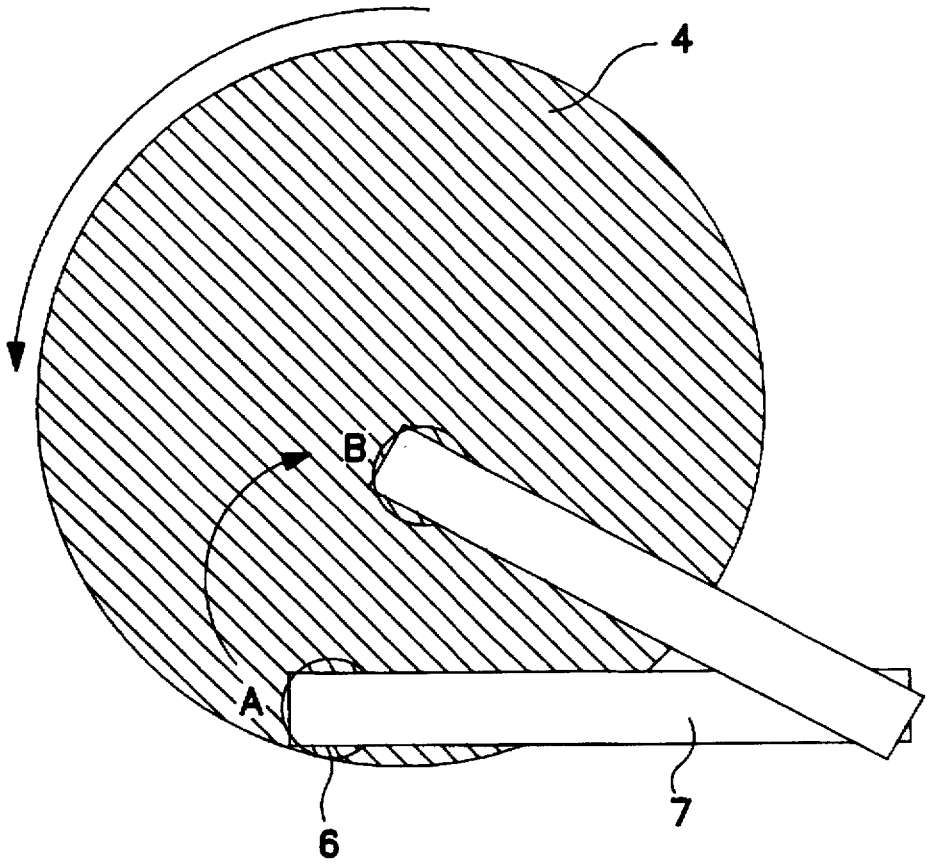
FIG. 9 is a plan view showing the manner in which the entire surface of a polishing pad is conditioned.

FIG. 5 is a view showing the state in which a conditioning disc employed in CMP according to a fifth embodiment of the present invention is on standby. The fifth embodiment will be described below using FIG. 5.

Even in the case of the present embodiment, a pad conditioning process done after a CMP process is similar to those employed in other embodiments.

In the fifth embodiment, a channel 37 for circulating water in a conditioning disc 31 is provided and an isothermal circulating water unit 30 is provided. There is also provided piping 36 for establishing a link between the isothermal circulating water unit 30 and the channel 37 in the conditioning disc 31.

The temperature of the conditioning disc 31 is adjusted by the water which circulates in the conditioning disc 31. Incidentally, the temperature of the circulating water is adjusted by the isothermal circulating water unit 30.

Thus, since it is unnecessary to circulate the water within the water tank 32, efforts for maintaining the isothermal circulating water unit 30 can be reduced and the structure can be also simplified. Since constant-temperature water directly circulates in the conditioning disc 31, the conditioning disc itself is controlled to a suitable temperature. Accordingly, the conditioning disc is always maintained at the suitable temperature and conditioning can be effected on a polishing pad in this condition. Further, since the water continues to control the temperature even if it flows out from the water tank, sufficient time can be made between the discharge of the water from the water tank and the commencement of the pad conditioning.

The present invention is not necessarily limited to the present embodiments. In the process for executing the CMP, a variety of conditions are considered according to materials to be polished. It is thus necessary to set the aforementioned stable temperature to various temperatures according to the condition. The present invention will not exclude these diversified stable temperatures.

While the present invention has been described with reference to the illustrative embodiments, this description is not intended to be construed in a limiting sense. Various modifications of the illustrative embodiments, as well as other embodiments of the invention, will be apparent to those skilled in the art on reference to this description. It is therefore contemplated that the appended claims will cover any such modifications or embodiments as fall within the true scope of the invention.

What is claimed is:

1. A method of polishing a wafer, comprising the following steps:

a step for pressing the wafer against a polishing portion on a polish wheel and applying relative motion between the wafer and the polish wheel so as to polish the surface of the wafer;

a step for controlling a conditioning tool to a predetermined temperature; and a step for conditioning the polishing portion using the conditioning tool.

2. A method according to claim 1, wherein said predetermined temperature is a stable temperature of the polishing portion in said wafer surface polishing step.

3. A method according to claim 2, wherein said stable temperature is about 28° C.

4. A wafer polishing apparatus for pressing a wafer against a polishing portion on a polish wheel and applying relative motion between the wafer and the polish wheel so as to polish the surface of the wafer, comprising:

a conditioning tool for conditioning the polishing portion; and a control mechanism for controlling said conditioning tool to a predetermined temperature.

5. A wafer polishing apparatus according to claim 4, wherein said control mechanism is a heater provided within said conditioning tool.

6. A wafer polishing apparatus according to claim 4, wherein said predetermined temperature is a stable temperature of the polishing portion in a wafer surface polishing step.

7. A wafer polishing apparatus according to claim 6, wherein said stable temperature is about 28° C.

8. A wafer polishing apparatus for pressing a wafer against a polishing portion on a polish wheel and applying relative motion between the wafer and the polish wheel so as to polish the surface of the wafer, comprising:

a conditioning tool for conditioning the polishing portion; and a water tank storing therein a liquid of a predetermined temperature, into which said conditioning tool is immersed.

9. A wafer polishing apparatus according to claim 8, wherein said predetermined temperature is a stable temperature of the polishing portion in a step for polishing the surface of the wafer.

10. A wafer polishing apparatus according to claim 9, wherein said stable temperature is about 28° C.

11. A wafer polishing apparatus according to claim 8, further comprising a control device for controlling the temperature of the liquid which flows into said water tank.

12. A wafer polishing apparatus according to claim 8, further comprising a heater provided within said water tank.

13. A wafer polishing apparatus for pressing a wafer against a polishing portion on a polish wheel and applying relative motion between the wafer and the polish wheel so as to polish the surface of the wafer, comprising:

a conditioning tool for conditioning the polishing portion; and a control device for controlling the temperature of a liquid;

said conditioning tool having a channel defined therein-side through which the liquid flows.

14. A wafer polishing apparatus according to claim 13, wherein said predetermined temperature is a stable temperature of the polishing portion in a step for polishing the surface of the wafer.

15. A wafer polishing apparatus according to claim 14, wherein said stable temperature is about 28° C.

* * * * *